United States Patent [19]

Asakawa et al.

[11] 4,107,357

[45] Aug. 15, 1978

[54] METHOD FOR EFFECTING ONE SIDE MOLTEN METAL PLATING

[75] Inventors: Kenichi Asakawa, Fukuoka; Makoto Yoshida, Kitakyushu, both of Japan

[73] Assignee: Nippon Steel Corporation, Tokyo, Japan

[21] Appl. No.: 723,626

[22] Filed: Sep. 15, 1976

[30] Foreign Application Priority Data

Sep. 16, 1975 [JP] Japan ..... 50-110947

[51] Int. Cl.[2] ..... C23C 1/02; C23C 1/03

[52] U.S. Cl. ..... 427/300; 427/321; 427/349; 427/432; 148/6.35

[58] Field of Search ..... 427/300, 321, 349, 433, 427/367, 431, 432, 282; 148/6.35

[56] References Cited

U.S. PATENT DOCUMENTS

| | | | |
|---|---|---|---|
| 1,430,649 | 10/1922 | Herman | 427/433 X |
| 1,933,401 | 10/1933 | Ward | 427/432 X |
| 3,383,250 | 5/1968 | Pierson et al. | 148/6.35 |
| 3,632,411 | 1/1972 | Stark | 427/432 |
| 3,681,118 | 8/1972 | Ohama et al. | 427/349 |
| 3,707,400 | 12/1972 | Harvey et al. | 427/432 X |
| 3,738,861 | 6/1973 | Sciffer et al. | 427/432 |

*Primary Examiner*—Ralph S. Kendall

*Attorney, Agent, or Firm*—Watson, Leavenworth, Kelton & Taggart

[57] ABSTRACT

A one side plated metal of excellent appearance and quality can be obtained by dipping the material into a plating bath. In this case, one side of the material is oxidized just before it enters the bath so as to form an oxide film on that side and leave it unplated. As soon as it is pulled up from the bath it is maintained under reducing atmosphere so as to prevent adherence of the plating metal to the oxide film.

5 Claims, 4 Drawing Figures

Fig. 2
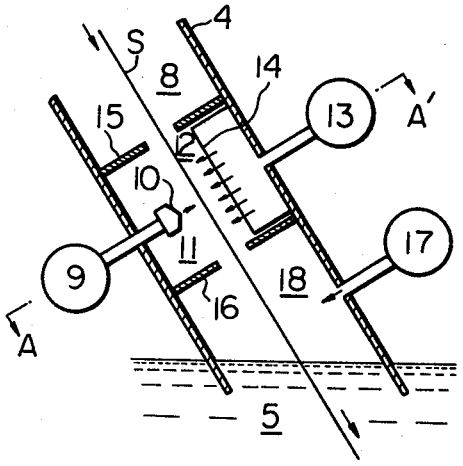
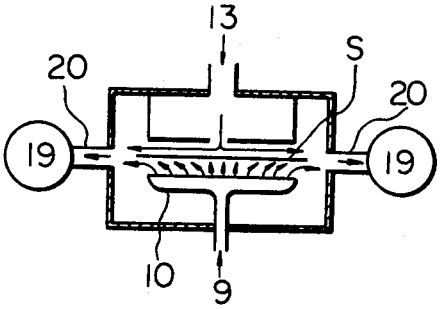
Fig. 3
Fig. 4
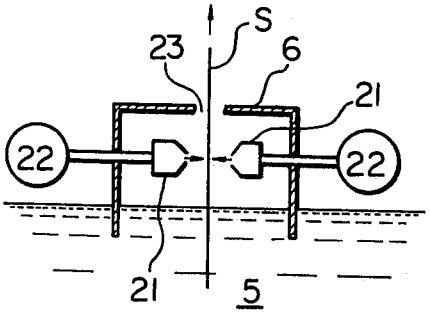

METHOD FOR EFFECTING ONE SIDE MOLTEN METAL PLATING

DETAILED DESCRIPTION OF THE INVENTION

This invention relates to a method for plating a molten metal or alloy such as zinc, zinc alloy, lead alloy, etc. on only one side of a metallic material such as steel, etc.

In recent years there has been an increasing demand for a molten metal plated steel sheet such as galvanized iron sheet from the standpoint of its anti-corrosion property. In case of use, however, the anti-corrosion property will often suffice with only one side of the sheet. That is, it is not always necessary, in many cases, that both sides of the sheet has the same degree of anti-corrosiveness. Moreover, in case of processing or assembling parts of automobiles or electrical appliances, where resistance welding is often used, there is a disadvantage that the plating metal builds up on the electrode with the result of spoiling the electrode and lowering the weldability.

Under these circumstances, it is a desideratum to establish a technic of one side molten metal plated steel sheet on a commercial basis. It has thus been proposed, as a method of producing one side molten metal plated steel sheet, to weld the edge of two lapped sheets and cut off the weld part after plating, or to seal one side by coating the same with various agents such as water glass, colloidal silica sol and the like, or to conduct plating by coating one side with molten metal by means of roll coating, or to plate a metal on both sides of a material and thereafter remove the plating metal from one side by chemical or electro-chemical dissolution. These methods have however, various problems in the production cost, production efficiency and product quality, etc.

Altertatively, there is a method as disclosed in U.S. Pat. No. 3,383,250 which is directed to a method of forming an oxide film on one side of a steel strip and effecting plating on only the unoxide opposite surface thereof. In this patented method, a steel strip is heated in a non-oxidizing furnace, oxidized by blowing oxygen or air to only one side thereof, and then introduced into a plating bath while the oxidized film is maintained in a protecting atmosphere of low hydrogen concentration. In this case, it is necessary to provide such condition as to prevent reduction of the oxidized film through the protecting atmosphere as well as to prevent oxidation of the surface to be plated. In other words, it is necessary to control the conditions of atmosphere and temperature rigidly so as not to cause any oxidation or reduction and, in addition, a material which has preliminarily been annealed should be used. This U.S. patent is thus concerned with a method which has its plating system limited and which can not be used widely in a commercial production of Selas type.

It is therefore an object of this invention to provide a method of producing a metal such as steel sheet having molten metal plating on one side thereof which can be produced with low cost, high productivity and high quality. It is another object of the invention to provide a method wherein a metal strip such as steel strip is subjected to activation treatment in a furnace having reduction atmosphere of Sendzimir system, Selas system or non-oxidation system, and then dipped into a plating bath for molten metal coating, which comprises blowing an oxygen-containing gas on only one side thereof to produce an oxidized film, dipping the resulting material into a plating bath of molten metal, maintaining a non-oxidizing atmosphere on the outlet side of the bath so as to prevent mechanical adherence of the plating metal to the oxidized surface whereby the plating can be effected on only unoxidized surface.

According to this invention, there is provided a method for effecting one side molten metal plating in which a material metal is subjected to activation treatment by heating in a reducing atmosphere and then dipped into a molten metal bath for continuous plating, which comprises blowing an oxygen-containing gas to only one side of the material after said activation treatment and then dipping the material into a molten metal bath for plating.

According to this invention, there is also provided a method for effecting one side molten metal plating in which a material metal is dipped into a molten metal bath for plating after a film which is difficult to react with the molten metal is formed on only one surface thereof, which comprises maintaining a non-oxidizing atmosphere at the outlet side of the bath and thereby preventing adherence of the plating metal to the surface of the material on which the film has been fromed.

According to this invention, there is further provided a method for effecting one side molten metal plating in which a material metal is dipped into a molten metal bath for plating after a masking film which is difficult to react with the molten metal is formed on only one surface thereof, which comprises maintaining a non-oxidizing atmosphere at the outlet side of the bath and wiping the material by means of a non-oxidizing gas.

According to this invention, there is still further provided a method for effecting one side molten metal plating in which a material metal is subjected to activation treatment on its surface to be plated by heating in a reducing atmosphere and then dipped into a molten metal bath for continuous plating, which comprises blowing an oxygen-containing gas to only one side of the material after said activation treatment and maintaining a non-oxidizing atmosphere at the outlet side of the bath whereby preventing adherence of the plating metal to the surface of the material on which the film has been formed.

In the practice of molten metal plating according to Sendzimir process and so on, the plating efficiency is lowered if a slight amount of water or oxygen exists in a reducing atmosphere, and it is thus necessary to avoid such mixing of these gases in order to obtain a good plated product. The one side plating technic according to this invention is based on the above fact, wherein a nitrogen-hydrogen gas or a nitrogen gas, etc., which contains a suitable amount of oxygen mixed therewith is blown to only one side of a material so as to instantaneously form an oxide film on the activated surface, and the resulting oxidized film will prevent an alloying reaction with the molten metal in the bath and thereby prevent formation of a plating layer thereon.

The concentration of oxygen in the blowing gas for one side oxidation varies with a line speed, a temperature of a strip when blown, an amount of a blowing gas and a blowing apparatus. As a result of various studies made by the inventors, it is found necessary to provide the oxygen concentration of 0.001% by volume at minimum based on the total amount of the blowing gas. As for the upper limit, there is no particular limitation from the standpoint of oxidation only, for the concentration may be low if the amount of the blowing gas is great while it must be high if the amount is small. However, for the purpose of avoiding possible danger of explosion caused by mixing with a reducing gas, the maximum concentration of oxygen in the blowing gas for one side oxidation should preferably be 1% by volume. It is also preferable that the blowing of an oxidizing gas be conducted just before the material enters the plating bath, that is, at the snout part. The temperature of the material sheet at the time of blowing gas should preferably be 300° C or more in order to form an oxidized film which is strong enough to prevent reaction with the molten metal, while on the other hand it should preferably be not more than 600° C for the purpose of suppressing formation of an alloy layer on the plating surface. The surface of a strip to which an oxidizing gas has thus been blown will not change color when the oxidizing condition such as the $O_2$ concentration, the amount of gas and the temperature of the strip material is not so strong. However, it will turn light yellow to blue color as the oxidizing condition becomes stronger.

In order to form a uniform oxidized film on only one side of the sheet, it is thus necessary to provide a one side oxidation treatment chamber at the snout part in which an oxidizing gas can be blown uniformly along the direction of the width of the sheet. In order to prevent bypass of the oxidizing gas over the reverse side of the sheet, it is necessary to prevent too much speed of the blowing gas from an oxidizing nozzle, that is, to keep the speed about 20 m/sec or less at the outlet of the nozzle, to allow a non-oxidizing gas to flow on the reverse side and to form a path for gas in which the bypass of the oxidizing gas toward the reverse side is difficult to occur. In this way, the oxidized surface is prevented by its oxidized film from wetting and alloying with the molten metal and thus from forming a plating layer even if it is dipped into a bath. However, if it is pulled up from the bath into the air immediately after it is dipped thereinto, the plating metal tends to adhere mechanically to the oxidized surface even if an alloyed layer has not been formed. The plating metal which has thus adhered to the oxidized surface must be removed by the use of an asbesto wiper or scraper in its molten state immediately after pulled up from the bath, or by the use of a brush, etc. after the plating metal is solidified. It gives rise to a new problem that it should be done uniformly and continuously and that a high cost is incurred due to loss of the plating metal. After many studies about how to prevent adherence of the plating metal to the oxidized surface when pulled up from the bath, the inventors have now found that the adherence of the plating metal to the oxidized surface can be prevented by maintaining an inert or reducing atmosphere, that is, a non-oxidizing atmosphere at the outlet side of the plating bath, particularly near the meniscus portion, whereby the above mentioned problem can be overcome advantageously. If the outlet side of the bath for the strip is maintained under the non-oxidizing atmosphere, the adherence of the plating metal to the oxidized surface can be prevented without any mechanical force. This theory is presumed as follows.

When a strip is pulled up from the plating bath into the air, the strip is continuously carried upwards. Accordingly, the oxidized surface of the strip is forcibly brought to the wet condition by the plating metal. The surface of the plating metal is itself covered by its own oxide, and due to its resistance a phenomenon of "repelling" is suppressed so that the plating metal will adhere uniformly. However, if the outlet of the plating bath is kept under a non-oxidizing atmosphere, the production of the oxide of the plating metal becomes small whereby the surface tension and viscosity due to the oxide is decreased. As a result, a contact angle which is in equilibrium between the oxide surface of the strip and the surface tension of the plating metal, that is, of phenomenon of "repelling" occurs instantaneously in the vicinity of the meniscus so that the adherence of the plating metal can be prevented. The way of shutting down the vicinity of the meniscus from the atmosphere is to introduce a non-oxidizing gas by providing a seal box, to cover the same by gas flame, etc. In case of using a seal box, the size of the box may vary widely so long as it can protect the vicinity of the meniscus at minimum. In practising this invention, a mere protection of the outlet side of the plating bath by keeping a non-oxidizing atmosphere thereover is enough to prevent adherence of the plating metal, but it is more advantageous to carry out the wiping by means of the non-oxiding gas.

As set forth hereinabove, the balance or equilibrium between the oxide film and the surface tension of the plating metal is applied, in this invention to the one side molten metal plating technic. Accordingly, it can be applied not only to a method of masking the non-plating surface by the oxide film but also to a method of masking said surface by coating various agents thereon. A way of plating is not limited to a gas reduction system but can be a flux system which gives as same effect as above.

This invention is further described in detail with respect to the attached drawings.

FIG. 2 is a schematic sectional view of one example of one side oxidizing apparatus according to this invention.

FIG. 3 is a sectional view taken along line A—A′ of FIG. 2.

FIG. 4 is a schematic sectional view of one example of a seal box at the outlet side of the bath according to this invention.

Figure 1:
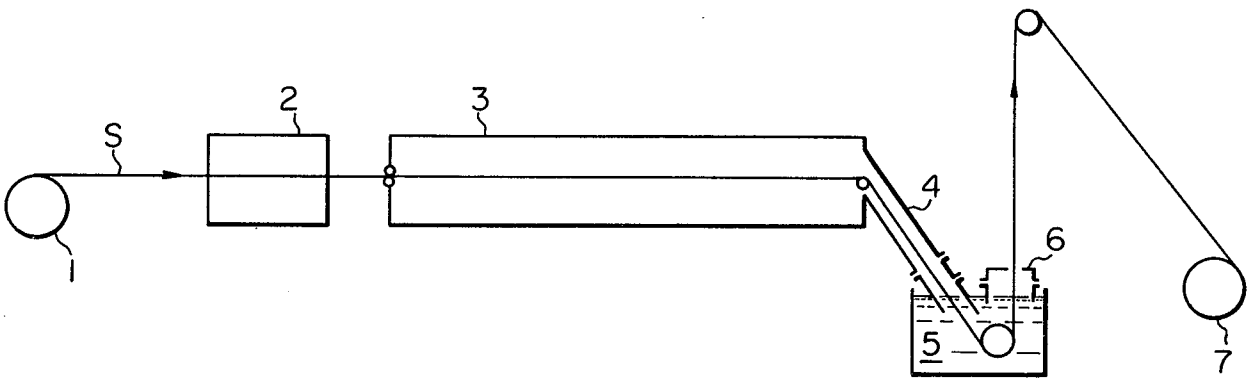
FIG. 1 is a schematic view of the general continuous molten metal plating line illustrating one embodiment of this invention.

In FIG. 1, a strip (S) is uncoiled in turn from an uncoiler 1 and passed into a preliminary treatment unit 2. This unit 2 may be an oxidizing furnace, a non-oxidizing furnace, or a degreasing pickling tub, etc. according to the particular plating system used, where the strip is cleaned on its surface. Then it is carried to a reducing furnace 3 which has been filled with a reducing atmosphere, where it is reduced and activated on its surface and adjusted to a temperature suitable for plating. The strip is thereafter blown with an oxidizing gas on one side thereof for oxidation just before it is dipped into a metal plating bath 5, for example, at a snout part 4. It is thus dipped into the plating bath 5 without contacting the outside atmosphere and finally carried upward from the bath 5. In this case, the outlet side of the bath 5 is filled with a reducing atmosphere by means of a seal box 6, whereby any plating metal adhereing to the oxide surface of the strip is removed. The strip is then cooled in the air and coiled by a coiler 7.

In other words, this invention may be practised in the conventional continuous plating line by oxidizing one side of a strip at the terminal end of the furnace 3 filled with a reducing atmosphere, for example, at the snout part 4; dipping the same into the plating bath 5 while the opposite or reverse side thereof is kept activated so that a formation of an alloy layer is prevented; and providing a seal box 6 at the outlet side of the bath whereby the repelling of the plating metal adhereing to the oxide surface is accelerated and the plating on only the non-oxidized surface is carried out. In this way, a one side plated steel sheet of lower cost and higher quality then the conventional one can be obtained by practising this invention.

In FIGS. 2 and 3, the numeral 8 is a part which is directly connected to a reducing furnace and which is filled with a reducing atmosphere. The numeral 11 is a one side oxidizing treatment chamber; 12 is a space where a non-oxidizing gas is allowed to pass so as to prevent the oxidizing gas from bypassing thereinto and causing oxidation; 18 is a seal chamber for the surface of a bath connected to a gas supply source 17 where a non-oxidizing atmosphere is maintained to prevent oxidation of the bath surface; and the numerals 15 and 16 are sealing elements adapted for preventing mutual interconnection of gases in each chamber, respectively. The numeral 10 is a nozzle for blowing an oxidizing gas which has an outlet for blowing gas of a slit-like shape extending widthwise of a strip and facing thereto. It is connected to an oxidizing gas supply means 9. On the side of the strip opposite to said nozzle 10 is the space or chamber 12 as mentioned above. In its center there is a slit-like outlet 14 for blowing a sealing gas extending along the travel of the strip. The chamber 12 is connected to a sealing gas supply means 13. In FIG. 3, a path for the oxidizing gas to oxidize one side of the strip and a path for the sealing gas to prevent oxidation of its reverse side are shown, wherein outlets 20 for such gases connected to exhaust means 19 are provided in the direction of both edges of the strip so as to form such flow of gases.

The oxidizing gas containing oxygen is adjusted by the gas supply means 9 with respect to its pressure, flow rate and oxygen concentration and allowed to blow out from the nozzle 10 to the strip which has been reduced and activated. The strip forms an oxide film at once and is covered thereby. The remaining gas which has not been consumed by the oxidation is immediately discharged from the outlets 20 to the outside. The non-oxidizing gas such as nitrogen or nitrogen-hydrogen mixed gas is allowed to blow out through the outlet or nozzle 14 from the means 13 after adjusted with respect to its pressure and flow rate. The gas flows then along the direction of both edges of the strip where it joins with the oxidizing gas and is discharged together from the outlets 20 to the outside. It is necessary to prevent oxidation of the surface of the bath in the snout part for the purpose of obtaining a beautiful plating surface of the strip, and also it must be considered to prevent reduction of the oxidized surface as well as oxidation of the activated surface. In view of these points, it is preferable to use a neutral atmosphere such as nitrogen, argon gas, etc., which may be introduced into a bath surface sealing chamber 18 from a supply means 17 not shown after adjusted with respect to its pressure and flow rate. This bath surface sealing gas is then passed through the lower sealing element 16 to join with the oxidizing gas and the reverse side sealing gas, and discharged from the outlets 20 by the exhaust means 19 after adjusted with respect to its pressure and flow rate.

In FIG. 4 is shown the seal box 6 for the outlet side of the plating path, the lower side of which is open and dipped into the bath 5, and the upper side of which is sealed except for an outlet 23 for the strip. The numeral 21 indicates nozzles for blowing a gas adapted for use as wiping, which are provided on each side of the strip facing to each other. Each nozzle 21 has a slit-like gas opening extending along the width of the strip and is connected to the gas supply means 22.

The strip (S) which has been oxidized on its one side is dipped into the bath 5 and then pulled upwardly as mentioned, where a non-oxidizing atmosphere is kept inside the seal box 24 and is also supplied from the wiping nozzles 21 after adjusted with respect to its temperature, pressure, and flow rate. Since a non-oxidizing atmosphere is maintained inside the seal box 6 to cause the repelling phenomenon and also gives the wiping or scrping action, the plating metal does not adhere to the oxide surface of the strip while it adheres to the non-oxidizing surface in a suitable thickness by means of the wiping action. The strip is thereafter drawn up in the air, cooled and coiled. The factors which have an effect upon the wiping are the thickness of the slit of the nozzle 21; the pressure and temperature of the wiping gas; and the distance between the tip end of the nozzle and the strip (S). These factors may be determined in connection with the velocity of travel of the strip as far as the wiping for its non-plating surface is concerned, and in connection with the velocity of travel of the strip and the thickness of the plating layer required as far as the wiping for its plating surface is concerned. In FIG. 4, a gas which is filled inside the seal box 6 after used for wiping is shown as discharged from the outlet 23. Alternatively, by raising the lower end of the seal box 6 from the surface of the bath, a gap thus formed is used as another outlet in addition to the outlet 23. These and other ways for discharging the wiping gas may be used effectively in this invention so long as the non-oxidizing gas can be filled inside the seal box and also used as the wiping gas therein.

Examples of this invention are shown hereinafter.

EXAMPLE 1

In a Sendzimir galvanizing process, a one side oxidizing apparatus as shown in FIG. 2 is provided at the snout part of the line. A nitrogen gas containing not more than 1% by volume of oxygen is blown to one side of the strip from an oxidizing nozzle having the thickness of 1 mm. The strip is then dipped into a molten zinc bath where the zinc plating is effected at the rate of 20 m/min. A seal box as shown in FIG. 4 is provided at the outlet side of the seal box, where a nitrogen gas heated at 300° C is blown for wiping under the pressure of 1 kg/cm$^2$. The sealing gas used are all nitrogen. The appearance of the one side zinc-plated or galvanized steel sheet thus obtained is shown below.

Table 1

| Amount of $O_2$ added (%) | Appearance: Flow rate of oxidizing gas (100 l/min) | | Flow rate of oxidizing gas (2000 l/min) | |
|---|---|---|---|---|
| | non-plated (oxidized) surface | plated (non-oxidized) surface | non-plated (oxidized) surface | plated (non-oxidized) surface |
| Not added | 100% plated | 100% plated | 100% plated | 100% plated |
| 0.001 | 5% not plated | 100% plated | 100% not plated | 100% plated |
| 0.01 | 90% not plated | " | " | " |
| 0.1 | 100% not plated | " | " | " |

Table 1-continued

| Amount of $O_2$ added (%) | Appearance: Flow rate of oxidizing gas (100 l/min) | | Flow rate of oxidizing gas (2000 l/min) | |
|---|---|---|---|---|
| | non-plated (oxidized) surface | plated (non-oxidized) surface | non-plated (oxidized) surface | plated (non-oxidized) surface |
| 1 | " | " | " | " |

Remarks:
(1) Condition for plating:
Thickness of sheet 0.8 mm
Width of sheet 914 mm
Reduction temperature 900° C
Reduction atmosphere $N_2$ 25% + $H_2$ 75%
(2) Condition for wiping;
Height of seal box 800 mm
Thickness of nozzle slit for wiping 0.5 mm
Position of wiping nozzle 400 mm high above bath surface
Distance between nozzle and strip 20 mm From the result of Table 1, it is seen that higher concentration of oxygen gas is required when its flow rate is lower and lower concentration of oxygen gas will suffice when its flow rate is higher; and that in any of these cases, the satisfactory non-plated surface is obtained and the plated surface gives an excellent appearance.

EXAMPLE 2

In a Selas process (furnace temp. 900° C; atmosphere $N_2$ 80% + $H_2$ 20%) for galvanizing a pre-annealed steel strip (thickness 0.8 mm; width 914 mm), a one side oxidizing apparatus as shown in FIG. 2 is provided at the snout part of the line. An oxidizing gas consisting of 0.1% oxygen and the rest nitrogen is blown to the strip from the oxidizing nozzle at the rate of 500 l/min. Thereafter the strip is dipped into a zinc-plating or galvanizing bath for conducting plating at the rate of 30 m/min. At the outlet side of the plating bath a seal box as shown in FIG. 4 is provided where a nitrogen gas heated at 300° C under pressure of 1 kg/cm$^2$ is blown to the strip for wiping. As a result of it, there is no adherence of zinc to the oxidized surface of the strip while there is no unplated portion on the reverse side, and thus a one side zinc plated steel strip showing excellent adherence of plating.

EXAMPLE 3

In a Sendzimir process for producing one side 10% lead-tin alloy plated steel, a one side oxidizing apparatus as shown in FIG. 2 is provided at the snout part of the line, where an oxidizing gas containing 0.05% oxygen and the rest nitrogen is blown from the oxidizing nozzle to one side of the strip at the rate of 500 l/min for effecting only one side oxidation thereof. The strip thus treated is dipped into a bath where the plating is conducted at the plating rate of 20 m/min. At the outlet side of the bath, a seal box is provided, into which a reduction gas consisting of 95% N + 5% H is introduced at the rate of 50 l/min. so as to maintain a non-oxidzing atmosphere therein. The lead-tin one side plated steel sheet thus obtained has no plating metal adhereing to its oxide surface while has no unplated parts on its plated surface. Moreover, it has very few pin holes and displays excellent anti-corrosion property.

We claim:

1. A method for effecting application of a one side molten-metal coating to a steel strip in which the steel strip is subjected to activation treatment by heating it in a reducing atmosphere and then dipping it in a molten-metal bath for effecting continuous coating, characterized in that a gas containing oxygen in an amount of 0.001% or more by volume is blown against only one side surface of the steel strip subjected to said activation treatment in a snout part of a line whereby an oxide film is formed on said one side surface, and immediately thereafter the steel strip is dipped in said molten-metal bath to effect coating of the other side.

2. A method according to claim 1 in which, immediately after said steel strip is dipped in said molten-metal bath, said steel strip is passed through a non-oxidizing atmosphere whereby adherence of the molten-metal to said one side is prevented.

3. A method according to claim 2 in which said steel strip is subjected to a wiping operation by means of application of a non-oxidizing gas flow to said one side while it is passing through said non-oxidizing atmosphere.

4. A method according to claim 2 in which said non-oxidizing atmosphere is maintained in a seal box provided at the outlet side of the bath.

5. A method according to claim 1 in which said molten-metal is a member selected from the group consisting of molten zinc, molten zinc alloy and molten lead-tin alloy.

* * * * *